US005559326A

United States Patent [19]

Goodley et al.

[11] Patent Number: 5,559,326

[45] Date of Patent: Sep. 24, 1996

[54] SELF GENERATING ION DEVICE FOR MASS SPECTROMETRY OF LIQUIDS

[75] Inventors: Paul C. Goodley, Cupertino; Steven M. Fischer, Hayward; Darrell L. Gourley, San Francisco, all of Calif.

[73] Assignee: Hewlett-Packard Company, Palo Alto, Calif.

[21] Appl. No.: 508,729

[22] Filed: Jul. 28, 1995

[51] Int. Cl.[6] ..... H01J 49/04

[52] U.S. Cl. ..... 250/288; 250/281; 250/282

[58] Field of Search ..... 250/288, 288 A, 250/281, 282, 423 R

[56] References Cited

U.S. PATENT DOCUMENTS 4,298,795 11/1981 Takeuchi et al. ..... 250/288

4,883,958 11/1989 Vestal ..... 250/288 A 4,935,624 6/1990 Henion et al. ..... 250/288 A 5,170,053 12/1992 Hail et al. ..... 250/288

5,285,064 2/1994 Willoughby ..... 250/288

*Primary Examiner*—Jack I. Berman

*Assistant Examiner*—Kiet T. Nguyen

[57] ABSTRACT

An improved method and apparatus for creating ions through shearing forces of high velocity liquid and gas streams without application of an external electrical field. Ions are susceptible to customary of analysis such as mass spectrometry.

9 Claims, 5 Drawing Sheets

SELF GENERATING ION DEVICE FOR MASS SPECTROMETRY OF LIQUIDS

FIELD OF INVENTION

This invention relates to mass spectrometry, more particularly to an apparatus and method for producing ions from liquid solutions of interest for analysis by mass spectrometry.

BACKGROUND

To take advantage of the information in the mass spectra of a compound, it is necessary to create ions. Conventional mass spectrometers operate on a beam of ions derived from the material to be analyzed, by deflecting the beam electromagnetically, electrostatically or by in a way which depends upon the mass-to-charge ratio of ions in the beam or by measuring the transit times of ions in a pulsed beam. Specimens to be analyzed with a mass spectrometer are generally converted to ions before introduction into the portion of a mass spectrometer that performs the mass analysis of the ion beam.

Ionizing liquid samples has been an ongoing challenge, especially as the demand for applicability and sensitivity has been ever increasing. Many samples of interest are not sufficiently volatile at ambient temperatures to form a gas, nor are they sufficiently thermally stable at elevated temperatures to change state from a liquid to a gas without thermal decomposition. The state change is usually required with most conventional liquid inlet systems. More than 90 percent of the 12 million compounds in the American Chemical Society Registry of Organic Compounds are unable to change state without thermal decomposition. This limitation precludes the application of ionization methods such as bombardment of gas molecules with very high energy ions or electrons to form additional ions such as in electron impact ionization, or introducing chemically reactive high energy ions into the gas phase such as Fast Atom Bombardment (FAB) or Desorption Chemical Ionization. In research applications such as field toxin analysis, or in applications requiring ultra sensitivity (such as the detection of small molecules of glycine in amino acid analysis), the analysis poses ever increasing challenges.

Techniques exist for generating ion vapors from compounds of low volatility (i.e. electrospray ionization, field ionization, laser assisted field desorption, plasma desorption). Creating ions through external application of a charge is not uniformly successful, as not all compounds can be ionized to a high degree. To date, all known methods have limitations and none is useful for all types of compounds.

SUMMARY OF THE INVENTION

The invention taught herein provides an improved method and apparatus for forming ions from a liquid and introduction of ions into a mass spectrometer. Ion formation is accomplished without the application of an external electric field, requiring only the interaction of a concentric flow of gas around the liquid sample stream and the liquid stream at the appropriate relative velocities to create ions by means of triboelectric or frictional charging.

One novel aspect of the invention taught herein is the application of the triboelectric effect in a veritable micro environment. The triboelectric effect is commonly known as "frictional electricity", the charging of two different objects rubbing together or in relative motion with respect to each other and the shearing of electrons from one part to another. The charging effect can easily be demonstrated with silk and glass. In the invention taught herein, the substances in relative motion are the gas and the liquid. The innovation allows the elimination of currently required external charging to create ions from liquid samples prior to mass analysis as well as a substantial increase in the sensitivity as compared with external charge systems currently in use.

In one embodiment, the invention taught herein provides an apparatus for forming ions from a liquid prior to introduction into a mass analyzer, comprising:

a liquid inlet or capillary to receive the liquid sample to be analyzed, said capillary defining a nozzle on one end thereof, and pumping means coupled to said inlet to controllably move said sample though said inlet in a liquid sample stream and out of nozzle;

pneumatic nebulizer downstream, including;

chamber to receive said sample;

gas flow introduction device coupled to said chamber whereby a gas is introduced in a manner so said gas is caused to flow concentrically around said sample stream;

pumping device attached to said chamber to control velocity of gas and liquid sample flow;

nozzle device formed in and by the nebulizer housing through which gas and sample flow and through which point, as a result of the velocity of said gas and liquid and the physical interactions between gas and liquid, ions are dispersed into the connecting chamber, said connecting chamber effectively coupling said pneumatic nebulizer with a collecting pad such that ions projected by the nozzle are contained within said connecting chamber and collected at said collection pad, which ,operates as an inlet to the mass spectrometer. The nebulizer axis is typically at between 0 and 90 degrees relative to the inlet axis of the mass spectrometer ion inlet-orifice or fixed leak.

In another embodiment, the invention taught herein further comprises:

a tubular heater device between the nebulizer and the atmospheric pressure chamber whereby the ions created are directed along a contained space under conditions minimizing un- ionized droplets from coalescence prior to encountering said collection region.

In another aspect, the invention taught herein provides a method for forming ions from a liquid sample and for introducing said ions into a mass spectrometer, comprising A) directing said liquid through a liquid inlet having a free end, said free end leading to a tubular chamber, B) directing a high velocity stream of inert gas into a concentric annular chamber surrounding the tubular chamber though which the liquid is passing so that the gas flows concentrically in a chamber around the tubular chamber containing the liquid stream and both gas and liquid, in their respective chambers flow in a downstream direction, C) controlling the conditions of flow and contact of the flows of gas and liquid such that the triboelectric effect operates to generate ions from the liquid and into a intercommunicating chamber at sub atmospheric, atmospheric pressure and super atmospheric pressure, D) guiding ions across the intercommunicating chamber and towards a mass spectrometer inlet (MS inlet), said MS inlet feeding ions into the mass analyzer coupled to said inlet.

DETAILED DESCRIPTION OF THE PREFERRED EMBODIMENT

Figure 1A:
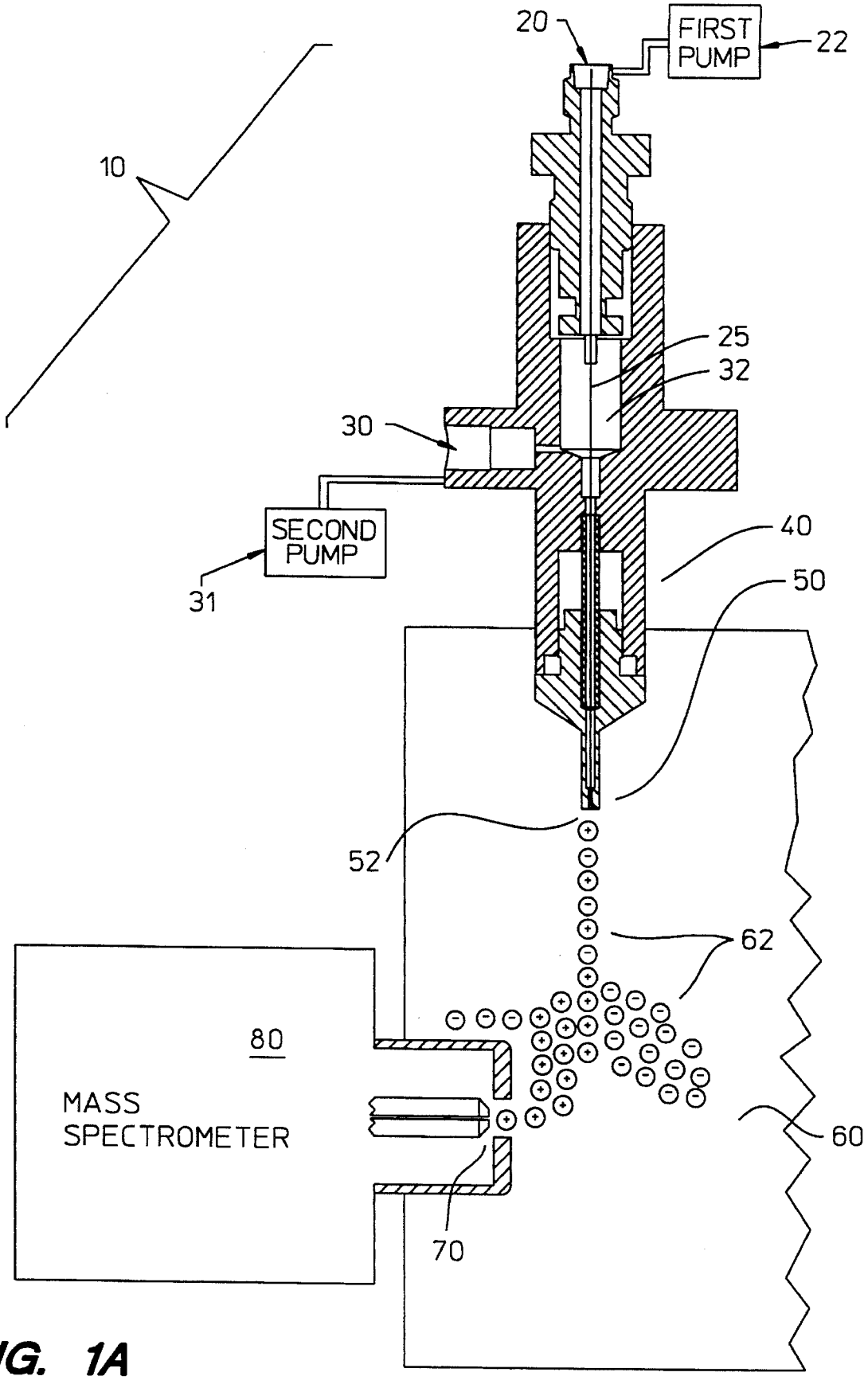
FIG. 1A through 1B inclusive is a diagrammatic view of the apparatus according to the invention.

Reference is made to the drawings, which show diagrammatically at FIG. 1A an LC/MS 10 adapted to include the present inventive features. The basic LC/MS instrument is sold by Hewlett-Packard Co. under the product identifier 1090A/5989B. It includes a liquid inlet 20 for LC effluent or other liquid sample and coupled to the inlet 20 is a first pump 22 operable to create positive pressure on the liquid sample. LC effluent rate of flow is generally 0.100 to 5000 microliters per minute and typically 1000 microliters per minute. Coupled to liquid inlet is a tubular chamber 25 through which the liquid flows, anti coupled to exterior of the tubular chamber 25 further downstream a gas inlet 30 whereby gas is introduced into an annular chamber 32 surrounding the tubular chamber 25 in a concentric manner and where further downstream a micro-pneumatic nebulizer 40 coupled to the tubular chamber containing the liquid flow such that at the exit aperture 52 or entrance into the ion chamber 60, the point the tubular chamber 25 terminates and the liquid flow encounters the gas flow 50, the triboelectric effect operates such that ions 62 are created in quantities measurable between from about $10^{-12}$ and $10^{-6}$ amps and said ions enter the ion chamber 60.

In operation, the liquid sample to be analyzed passes through the liquid inlet 20, into the tubular chamber 25. At a point downstream, the gas inlet 30 introduces an inert gas, usually nitrogen, under pressure typically of 100 psi, in such a manner that the gas travels in the direction of the liquid flow but in a concentric annular chamber 32. The pressure exerted on the flowing gas and liquid is supplied by a second pump 31 which includes a compressed gas cylinder (not shown), and said controlled second pump is to create velocities greater than 100 meters per second.

Figure 1B:
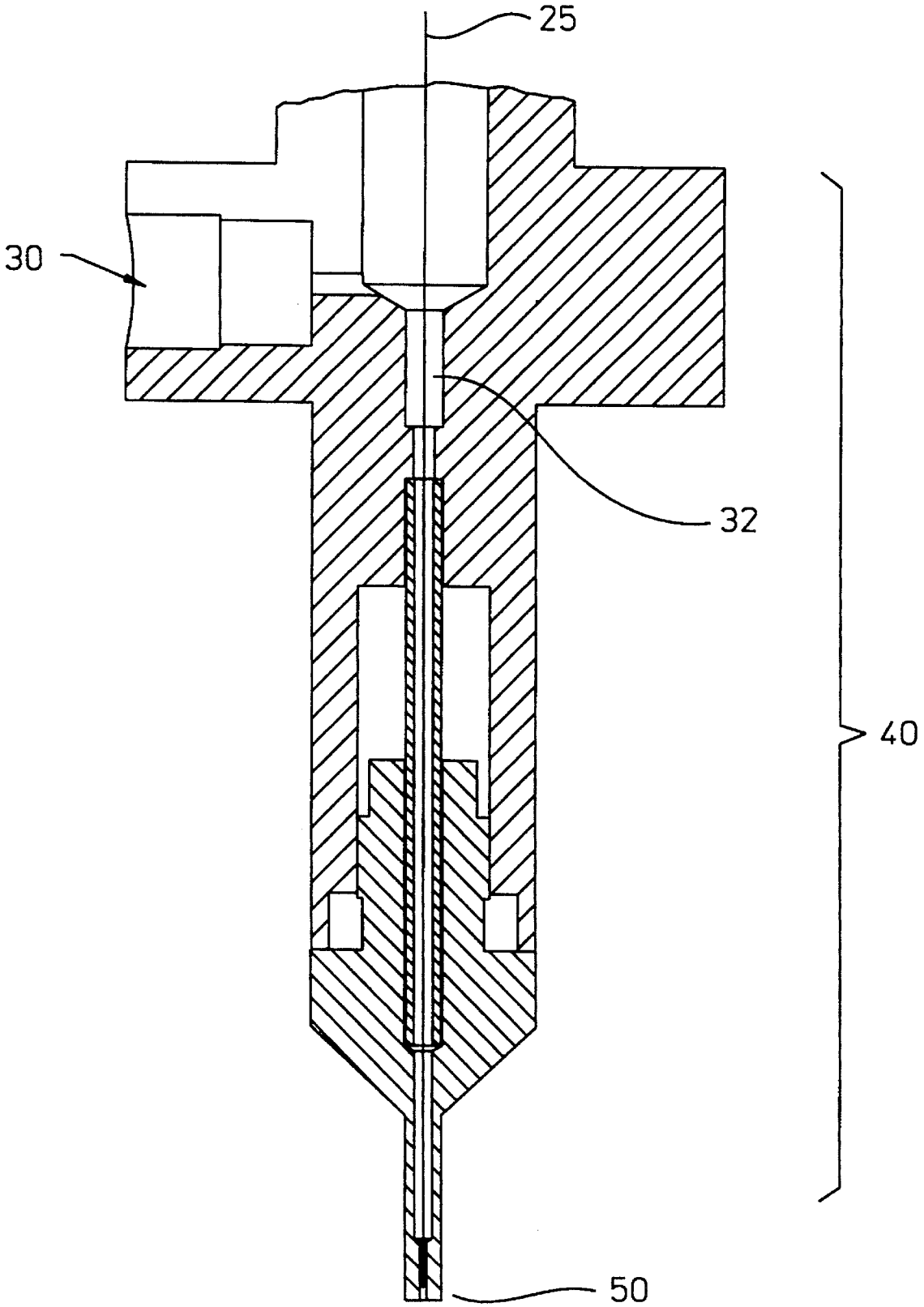

As depicted in enlarged section FIG. 1B, the triboelectric effect operates at the point the gas and liquid flow contact each other 50. The friction of the two streams with differing velocities contacting each other causes the shearing of ions 62 from the liquid stream, which ions enter the ion chamber 60 at the chamber entrance 52. The chamber is maintained above ambient temperature depending on liquid flow rate and the heat capacity of the liquid being used in order to maximize the number of ions arrive at the inlet to the MS.

Typically the liquid inlet 20 will be a tube of 100 micrometer inner diameter. The tube is sealed at its end to the tube using either a conducting or non-conducting polymer material such as KEL-F, Polyamide, or other materials that may withstand the pressure. The tube can be either a conducting tube or a non-conducting tube such as stainless steel needle tubing or fused silica tubing. Other tubing or channeling materials may also be used provided velocities the high liquid gas velocities are maintained. The tubular chamber 25 is usually about 1 centimeter in length, and generally the length being in the range of between 0.2 to 6 centimeters but may be any length suitable to the instrument. The gas inlet 30 allows a gas, typically nitrogen, to be introduced from a gas source (not shown); the source is connected to the gas inlet 30. Other gases may be used. Nitrogen supplied at a pressure of 7.5 barr into the annular space of the outer tube 32 creating a high gas velocity throughout the length of the outer tube 32. Proper gas velocity is key to creating ions via triboelectric effect. If the gas velocity drops below the 100 meter per second, for example, in the above tubing geometry, the number of ions drops precipitously and reduces the production of ions from the device. The liquid flow can range from as low as several nanoliters per minute and reach upwards of 5000 microliters per minute. The gas flows in the annular chamber 32, an outer tube running concentrically around the tubular chamber 25 containing the liquid. The gas flows at a rate of 80 meters/second to 800 meters/second. Typical ion production is on the order of 30 to 100 nanoamps.

The nebulizer 40 is a pneumatic nebulizer type which contains a concentric tubes.

Ion creation occurs at the contact point of the concentrically flowing high velocity gas and the liquid (the contact point 50) which is also the point at which ions are sheared loose due to the triboelectric effect. As depicted in FIG. 1, the ions are ejected, from the droplets from the shearing of the droplets and the separation of the ions from droplets as the droplets evaporate. The interconnecting ionization chamber 60 enclosably connects the ion exit or ion chamber entrance 52 with the mass spectrometer inlet 70 or other ion collection device.

Figure 2:
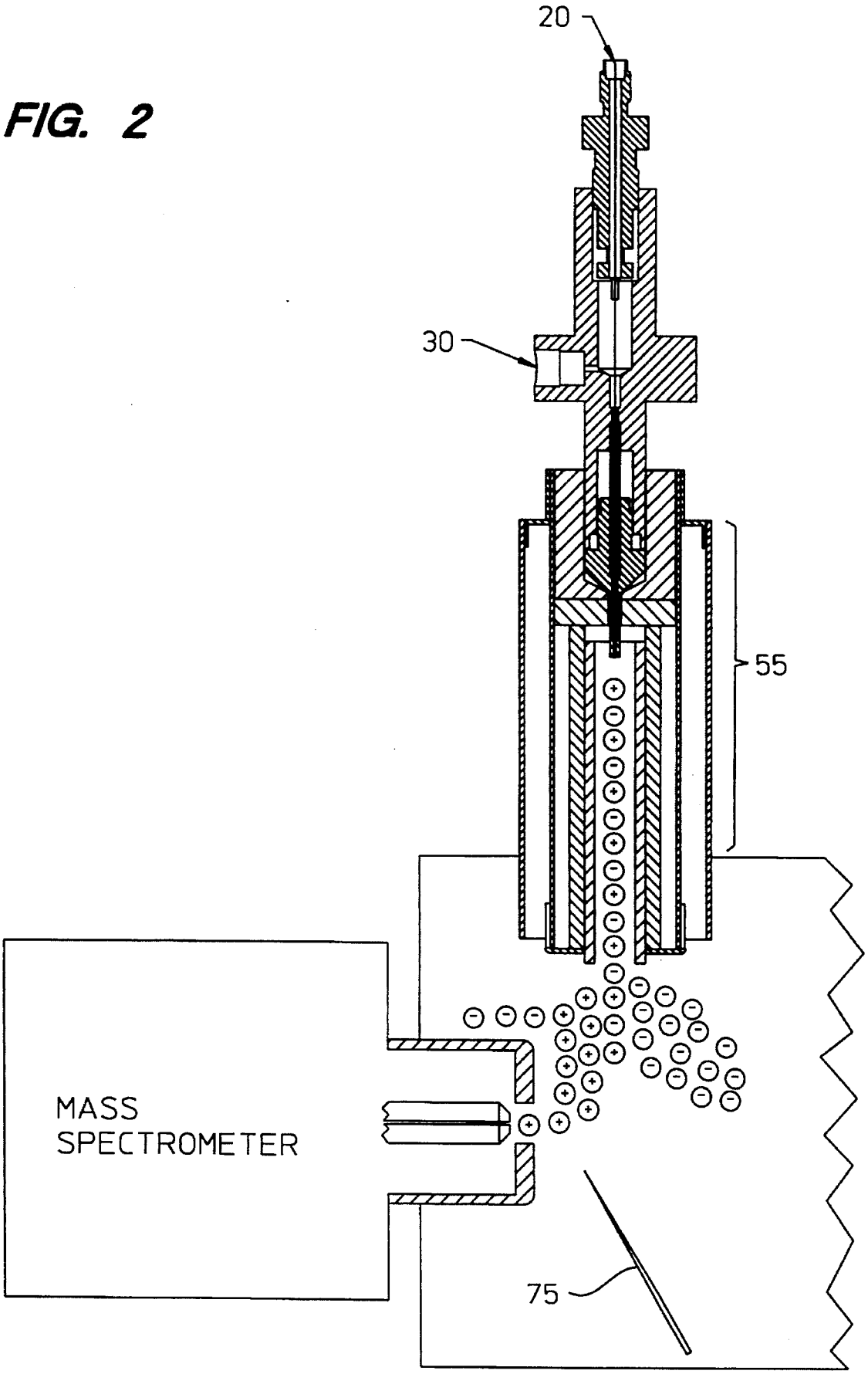
FIG. 2 is a diagrammatic view of a micro-pneumatic nebulizer and a concentric heated vaporizer according to the invention, and FIG. 3, 3A through 3B, inclusive, includes graphic representations of ion abundance data obtained using the invention herein.

In an alternate embodiment depicted by FIG. 2, the triboelectric-effect-formed ions 62 first enter an enhancement means, and more specifically a post nebulizer heated column 55 and said heated column 55 guides the ions 62 to the inner ion chamber 60. The heated column 55 is preferably of about 0.8 millimeters in diameter and 25 millimeters long (although dimensions may range From between about 0.1 millimeters in diameter up to 30 millimeters in diameter and approximately 250 millimeters in length). The chamber is composed of an inner tube, preferably an insulating and conducting material such as ceramic but may be made of a conductor such stainless steel or fused silica, glass or a polymer such as polyamide. The chamber is controllably heated to temperatures which would supply enough heat to evaporate the liquid. Typical temperatures for a flow rate of 1 milliliter per minute of liquid would be 400 degrees Centigrade. Lower flow rates will have proportionately lower temperatures. The temperature ranges vary according to the quantity and the heat capacity of the liquid being used.

The heated column is controlled by a feedback controller where the temperature can be set to maintain the temperature to within plus or minus one percent. Although this heated column is not necessary, the column helps to control the production of ions at a constant level.

The electrode 75 serves to focus ions toward the MS inlets. Typical voltages in the electrode range From 1000 to 5000 volts relative to inlet 70.

Figure 3A:
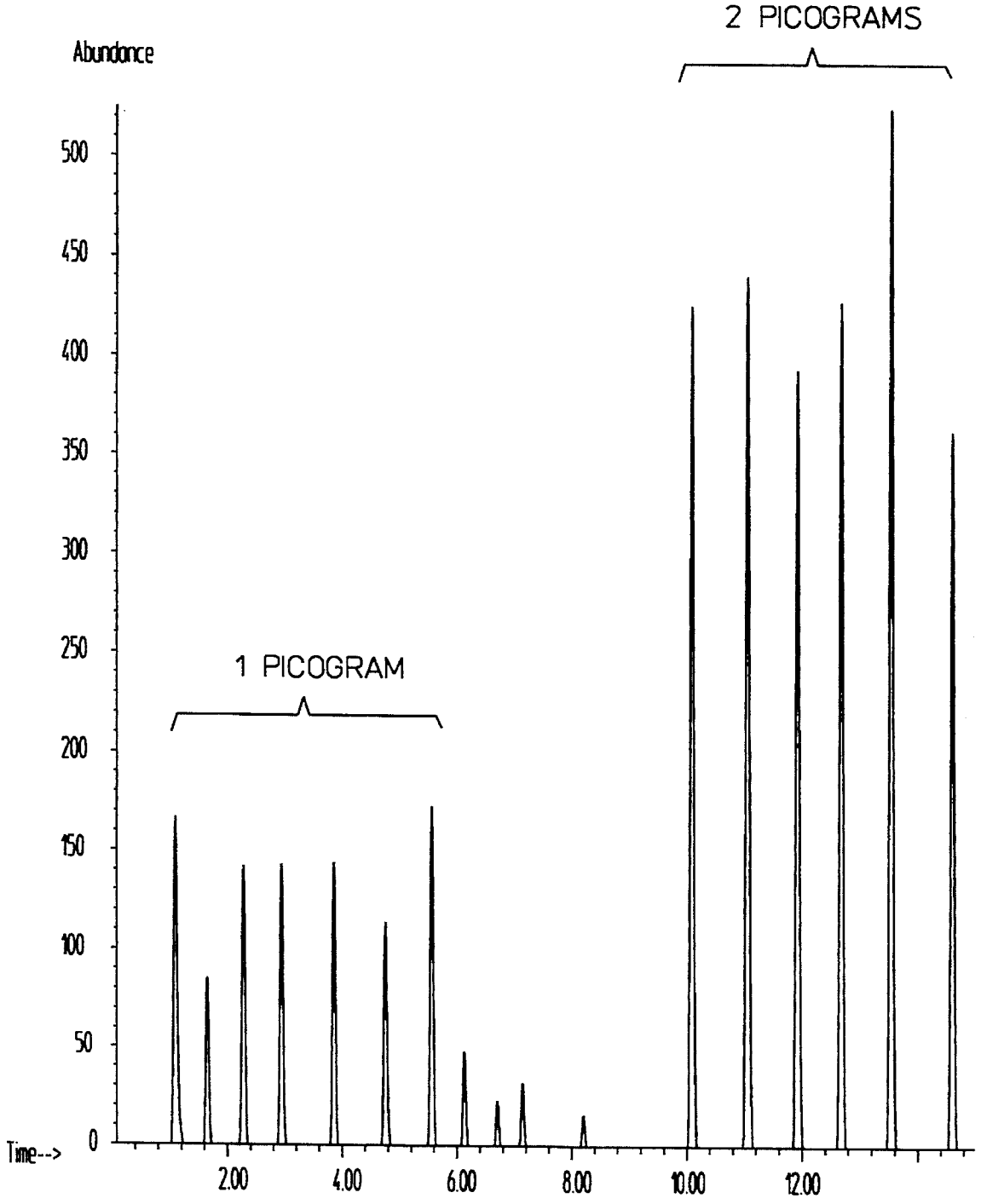
Figure 3B:
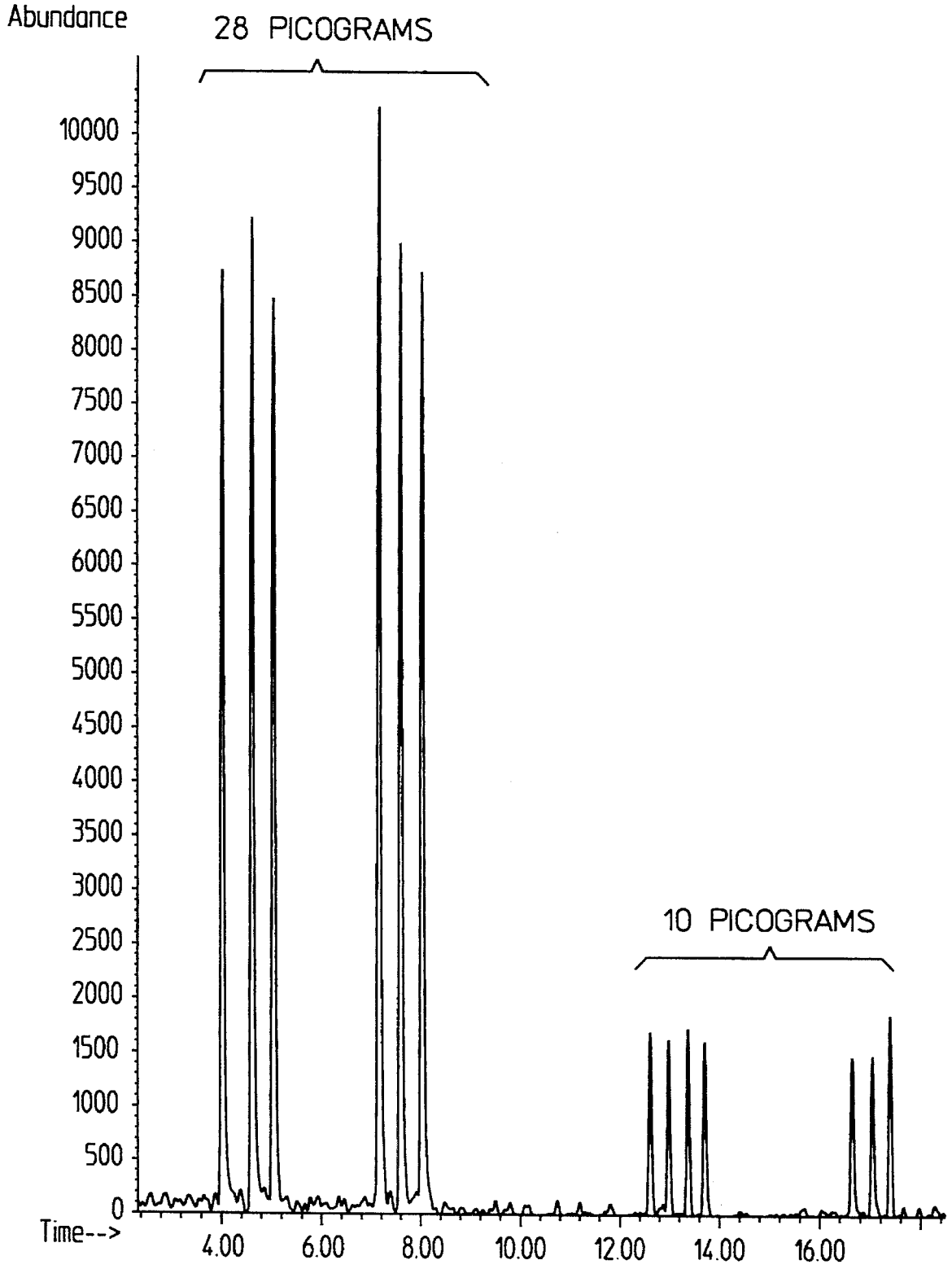

The results as depicted in FIG. 3, A through B inclusive, shows results from mass spectrometric analysis of samples handled by the apparatus and according to the method taught herein according to the present invention.

We claim:

1. An apparatus capable of creating ions from a liquid sample, said ions being suitable for mass analysis, comprising:

an inlet to receive said liquid sample, said inlet being further connected to a generally tubular first chamber and defining a nozzle on one end thereof and first pump attached to a controllably move said liquid sample through said tubular first chamber in a liquid stream and out of said nozzle;

a pneumatic nebulizer downstream from said inlet and coupled with said first chamber;

an annular second chamber surrounding said first chamber and both said first and second chambers extending laterally about substantially the same centerline, said second chamber defining a nozzle on one end thereof at a point in close proximity to said nozzle end of said first chamber;

gas flow introduction device attached to said second chamber whereby a gas is introduced in a manner so said gas is caused to flow in said second chamber parallel to the flow of said liquid sample stream in said first chamber;

a second pump attached to said second chamber to control velocity of said gas relative to said liquid sample flow in said first chamber;

nozzle device formed in and by the nebulizer housing through said gas and said liquid sample flow and through which point, as a result of the velocity of said gas and liquid and the physical interactions between gas and liquid, ions are created and dispersed into a collecting chamber.

2. The apparatus as in claim 1 wherein the relative velocity of the gas to the liquid is in the range of about 80 meters/second to 800 meters/second.

3. The apparatus as in claim 1 further comprising an enhancement means whereby the ions created are directed along a contained space under conditions minimizing coalescence.

4. An apparatus as in claim 3 wherein said enhancement means comprises a heated channel device coupled to said nozzle and maintained at a temperature sufficient to ensure that ions travel the length of the channel without coalescing.

5. An apparatus as in claim 4 further comprising a channel device which comprises a tube.

6. An apparatus as in claim 1 further comprising a means of producing usable ions at between $10^{-12}$ and $10^{-6}$ amps.

7. An apparatus as in claim 1 further comprising an interconnection between said ion chamber and an inlet of a mass analyzing device.

8. A method for forming ions from a liquid and for introducing said ions into a mass spectrometer, comprising the steps of:

a) directing said liquid through an inlet, said inlet coupled to a tubular chamber having a free end, b) directing a high velocity stream of inert gas into an annular chamber said annular chamber concentric around the tubular chamber through which the liquid is passing so that said gas flows concentrically around the tubular chamber containing the liquid and both said gas and said liquid flow in a downstream direction, c) controlling conditions of flow of said gas and said liquid, including the point of ion formation at which and the circumstances under which contact is made between said gas and said liquid flow such that the triboelectric effect operates to shear ions from the liquid, d) controlling flight of said ions, including controlling entrance into an intercommunicating chamber connecting said point of ion formation with said mass spectrometer such that said ions arrive at a mass spectrometer inlet.

9. A method as in claim 8 further comprising the step of producing ions whereby the number of ions produced is from about $10^{-12}$ to $10^{-6}$ amps.

* * * * *